United States Patent [19]

de Wit

[11] 4,128,914

[45] Dec. 12, 1978

[54] WEIGHT AND WEIGHT END PIECE FOR VERTICAL SLAT BLIND

[75] Inventor: Hendrik de Wit, Rotterdam, Netherlands

[73] Assignee: Hunter Douglas International N.V., Curacao, Netherlands Antilles

[21] Appl. No.: 782,315

[22] Filed: Mar. 29, 1977

[30] Foreign Application Priority Data

Mar. 31, 1976 [DE] Fed. Rep. of Germany ..... 2613749

[51] Int. Cl.[2] ..... E05F 7/00

[52] U.S. Cl. ..... 16/1 R; 160/178 R; 160/349 R

[58] Field of Search ..... 16/1 R; 160/173, 178 R, 160/172, 168, 349 R

[56] References Cited

U.S. PATENT DOCUMENTS

| | | | |
|---|---|---|---|
| 2,405,255 | 8/1946 | Horton | 160/173 |
| 2,497,803 | 2/1950 | Smalley | 160/173 |

FOREIGN PATENT DOCUMENTS

| | | | |
|---|---|---|---|
| 1659592 | 10/1969 | Fed. Rep. of Germany | 160/172 |

*Primary Examiner*—Dorsey Newton

*Attorney, Agent, or Firm*—Pennie & Edmonds

[57] ABSTRACT

The invention relates to a slatted blind having vertically arranged slats, in a bottom pocket of which a slat weight is maintained by means of an end piece mounted at each end of the weight.

9 Claims, 4 Drawing Figures

WEIGHT AND WEIGHT END PIECE FOR VERTICAL SLAT BLIND

PRIOR ART

It is known that weight end pieces for vertical slat blinds may be constructed so that the weight is held on one side by a tab arranged in the middle portion of the end piece and on the other side by two tabs adjoining the two end portions of the end piece. That is to say that the tabs are offset from the lengthwise centerline of the end piece towards its side edges forming a gap passing through between the tabs, in which the end piece can be inserted.

Between the inside of the tab arranged in the middle portion of the end piece and the part of the surface of the weight making contact on the inside, a catch is provided. Such fastenings are employed in a variety of forms to connect the end piece and the end of the slat in blinds of this kind. In the region of the tabs arranged at the ends of the end piece additional guides are provided which engage matching recesses in the weight when it is inserted.

This construction has the disadvantage that, due to usually small tolerances, a satisfactory seating of the end piece on the weight is not always obtained. In addition, the end piece must be made comparatively heavy and stable since otherwise smooth contact of the tabs is not assured. The under side of the slat is thereby rendered unsightly. Also, the end piece tends to be costly.

BRIEF DESCRIPTION OF THE INVENTION

Starting from this point, the object of the invention was to provide a lighter connection, cheaper and problem-free in manufacture, between the end piece and the weight for a slatted blind of the type initially mentioned.

To accomplish this object, it is proposed according to the invention that the end piece be made U-shaped and provided with resilient arms embracing the ends of the lengthwise edges of the weight, that the inside of one arm together with the lengthwise edge of the weight form a catch to secure the end piece against being pulled off, and that each arm be connected to the middle portion of the end piece by a brace passing on one side of the weight, each brace acting on its respective arm short of the portion having the catch element.

This construction results in an end piece simple to manufacture and easily installed, each of its arms forming a catch with the two lengthwise edges of the weight. A straight and dependable seating of the end piece on the weight is assured. Until they reach the catch, the arms bend apart slightly during assembly. The resiliency required for this need not be great; as the end piece is ordinarily of sythetic material such as molded plastic, the inherent resiliency of the material will suffice. In particular, resiliency is required only in the end region of the arms, each of which may, for example, have on its inside a catch lug forming one member of the catch. In order not to interfere with the resiliency in this region, the brace connecting each arm to the middle portion of the end piece acts on its respective arm short of the portion having the catch lug as mentioned above.

Since the brace passes on only one side of the weight, it is offset accordingly from the lengthwise centerline of the end piece. Hence the end piece is able to twist slightly when slipped onto the weight, and it has been found that the mounting of the end piece can be facilitated in this way.

In an advantageous embodiment of the invention each arm has a guide lug extending into the region of the catch at the end of the arm away from the brace, which guide lug guides the weight when it is being inserted. This further facilitates mounting of the end piece.

It is advantageous also, according to another proposal of the invention, for at least one of the arms to have a small guiding part extending in the angle between the arm and the middle portion of the end piece and making contact with the side of the weight opposite to that of the braces when the weight has been inserted. In this way, the weight is dependably held on such opposite side as well.

Further, it is proposed that in that region of the middle portion of the end piece where a brace acts, a hook extending outward is integrally formed. This hook is for an eye, a link of a chain or the like. This portion of the end piece is in fact especially strong, so that when neighboring slats are connected, by means of flexible tension members such as chains or cords engaging these hooks, a good mooring is available at this point.

BRIEF DESCRIPTION OF THE DRAWINGS

The detailed construction of the invention will be understood from the following description and the accompanying drawings, in which drawings.

DETAILED DESCRIPTION OF THE INVENTION

Figure 1:
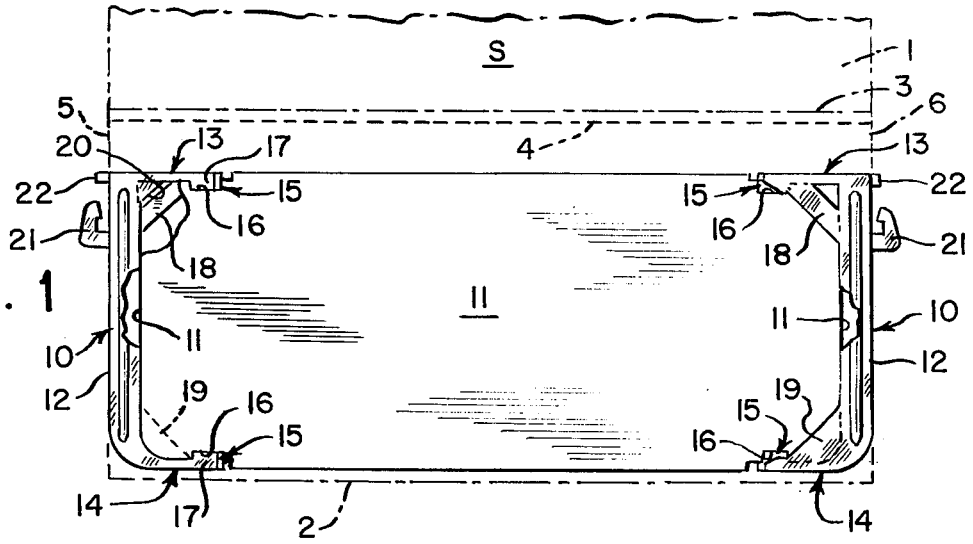
FIG. 1 shows a weight with end pieces mounted on both ends and with the lower end of a slat shown in phantom lines.
Figure 2:
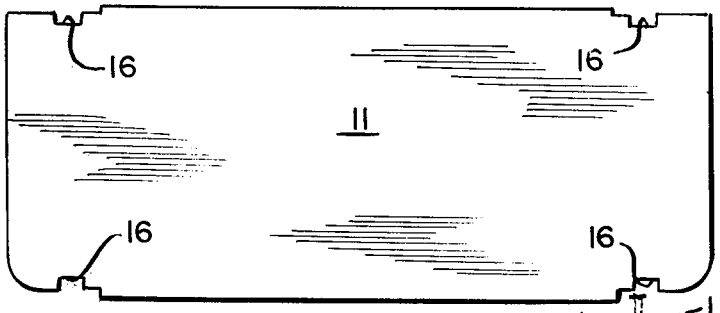
FIG. 2 shows the weight alone.
Figure 3:
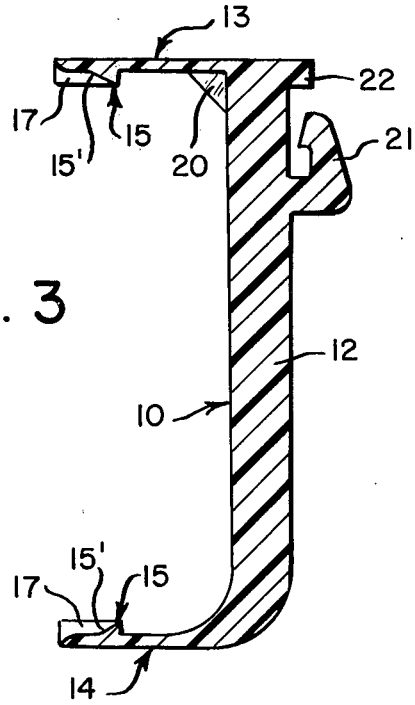
FIG. 3 shows a section through an end piece at the line III—III in FIG. 4.

A weight 11 provided with two end pieces 10 is shaped like a board, its length being nearly the width of a slat S. The slats S may be of any of several known materials including natural or synthetic textile fabrics, plastic or other sheet material, metal or the like. The material 1 of the bottom end of the slat S is formed into a pocket for receipt of the weight 11 by folding the material upward along the line 2 and then the terminal edge 3 of the material is secured to the material 1 along a line 4. The distance between fold 2 and line of securement 4 is sufficient to provide a pocket large enough to easily yet neatly receive the weight 11 and the major portion of the end pieces. The securement along line 4 may be stitching, heat sealing or other means depending upon the chosen material of the slats S and the choice of the designer. In order to clearly show the weight 11 and end pieces 10 the elements 1 through 6 are shown in phantom lines.

Each end piece 10 has a middle portion 12 at whose ends arms 13 and 14 adjoining at right angles are provided, completing the U shape of the end piece.

The arms 13 and 14 have projections 15 pointing inward in the region of their ends and capable of catching in recesses 16 in the end region of the lengthwise edges of the weight 11 when the latter is inserted in an end piece 10. A cam-like sloping surface 15' extending from projection 15 toward the end of arms 13, 14 aids in this insertion by urging the projections 15 apart. At the end of each arm 13 and 14 is a guide lug 17 which extends to one side of the lengthwise centerline, constituting the line of section III—III in FIG. 4, of the end piece 10. On the side of the lengthwise centerline opposite to that of the guide lugs 17 (i.e., to the right in FIG. 4) are braces 18 and 19. Braces 18 and 19 brace the arms 13 and 14 from the middle portion 12. The brace 18 is in the from of a truss, while the brace 19 is formed by a triangular area in the angle defined by the middle portion 12 and the arm 14 of the end piece 10. The point at which the braces 18 and 19 act on their respective associated arms 13 and 14 is located somewhat short of the projections 15, so that the stiffening of the braces does not extend all the way to the end regions of the arms 13 and 14 thus permitting the projections 15 to move apart as above mentioned.

Figure 4:
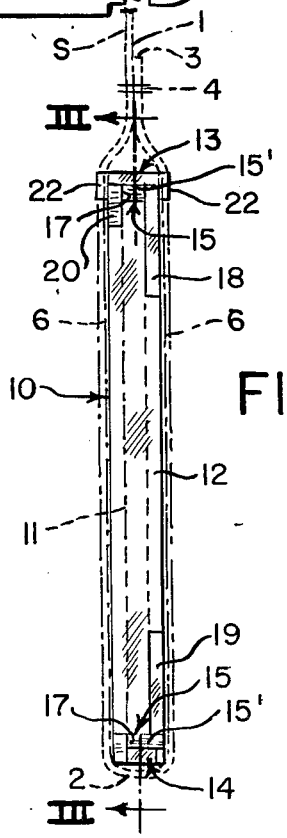
FIG. 4 shows an elevational view of an end piece in the direction of insertion of the weight.

When the weight 11 is inserted in the end pieces 10 the braces 18 and 19 make contact on only one side thereof. An additional small guide piece 20 is provided, connecting the arm 13 and the middle portion 12 at the transition between these parts and having the shape of a small triangle. The guide piece 20, as may be seen especially in FIG. 4, is so arranged that after insertion of the weight 11, it makes contact with the latter at its extreme corner on the side of weight 11 opposite to the braces 18 and 19.

In that region of the middle portion 12 where the brace 18 acts, a hook 21, molded integrally with the end piece 10, extends outwardly. This hook 21 is for engagement by an eye or a link of a chain to connect the weight 11 of this slat with the weight of a neighboring slat by means of a continuous cord, chain or the like.

When the weight 11 is inserted in an end piece 10, the weight is first laid on the projections 15 alongside the guide lugs 17. As the weight 11 is further inserted, the arms 13 and 14 of the end piece 10, made of synthetic material, bend apart slightly, especially the portions that extend beyond the braces 18 and 19, as the upper and lower edges of the weight act on cam surafces 15'. During insertion, due to the small size of guide piece 20, a slight torsion of the end piece 10 is also possible, if required, such that the arms 13 and 14 twist with respect to each other somewhat, especially if the insertion fails to take place in an exactly straight position. During the insertion, the weight 11 is guided on one side by the two braces 18 and 19.

The guidance on the other side is provided by the guide lugs 17 and guide piece 20. When the extreme position is reached, the projections 15 catch in the respective recesses 16 associated with them.

Depending upon how tightly the pocket at the bottom of the slat S is dimensioned with respect to the size of the weight and end pieces, the weight 11 may be inserted in the pocket either before or after being inserted in the end pieces 10 whichever is easier. Often, it will be found easiest to insert the weight 11 in one end piece 10 then to insert the weight and end piece into the pocket with the end of the weight without an end piece being inserted first. Then the other end piece is fitted into the pocket and onto the weight. This is so because ears 22 extend laterally of the major plane of the assembled weight 11 and end pieces 10 in order to engage the lateral side edges 5 and 6 of the slat S to prevent the weight from becoming shifted in or dislodged from the pocket.

I claim:

1. An article of the type described comprising a weight element having two oppositely facing substantially planar sides bordered by two opposite side edges and two ends, said planar sides being the major surfaces of said weight, said side edges being relatively narrow with respect to the width of said planar sides, at least one end piece, said end piece being generally "U" shaped, said end piece being dimensioned such that the arms of said "U" fit over and embrace the opposite side edges of said weight with said major surfaces extending between said arms, the arms of said "U" being resiliently springable apart, a catch element on each of said arms of said "U", a second catch element on each of the opposite side edges of said weight, said end piece when in position with its arms embracing said weight having the catch elements of its arms engaged with the catch elements of said weight for retaining said end piece in position on the end of said weight.

2. A slat for a vertically slatted blind comprising an elongated slat, a pocket at one end of said slat, a weight having two opposite side edges and two ends, said weight being positioned in said pocket, an end piece having a substantially "U" shape, the arms of said "U" embracing the opposite side edges of said weight, said arms also being within said pocket, catch means on each of said arms, catch means on each opposite edge of said weight engaged with the catch means of said arms to retain said end piece in position on one end of said weight, at least one ear extending laterally from said end piece at substantially a right angle to said arms, said slat having longitudinal side edges, and said ear being exterior of said pocket adjacent a longitudinal edge of said slat.

3. The article of claim 2 including a second like end piece engaged with said weight at the end opposite to that of the first mentioned end piece, said second end piece having its ear lying adjacent the longitudinal edge of said slat opposite to that adjacent the ear of the first end piece.

4. An article of the type described comprising a weight element having two oppositely facing substantially planar sides bordered by two opposite side edges and two ends, said planar sides being the major surfaces of said weight, said side edges being relatively narrow with respect to said planar sides, at least one end piece, said end piece being generally "U" shaped, said end piece being dimensioned such that the arms of said "U" fit over and embrace the opposite side edges of said weight, the arms of said "U" being resiliently springable apart, a catch element on each of said arms of said "U", a second catch element on each of the opposite side edges of said weight, said end piece when in position with its arms embracing said weight having the catch elements of its arms engaged with the catch elements of said weight for retaining said end piece in position on the end of said weight, said end piece including at least one brace extending from an arm to the middle portion of said "U" shaped end piece, and said brace and said end piece is in position on said weight lying to one side of said weight.

5. The article of claim 4 in which said end piece includes at least one guide lug adjacent the terminus of one of said arms, said guide lug when said end piece is engaged with said weight lying to the opposite side of said weight from said brace.

6. The article of claim 5 in which the arms of said end piece adjacent their termini include cam means for cooperation with the opposite side edges of said weight to aid in springing said arms apart during assembly of the weight and end piece.

7. The article of claim 6 in which said end piece includes a guide element between one of said arms and the middle portion of said "U", said guide element when said end piece is engaged with said weight lying to the opposite side of said weight from said brace.

8. The article of claim 7 including at least one ear extending laterally of said end piece at substantially a right angle to said arms.

9. The article of claim 4 in which said brace terminates on said arm short of the catch element of said arm.

* * * * *